US010052005B2

(12) United States Patent
Konkey

(10) Patent No.: US 10,052,005 B2
(45) **Date of Patent: *Aug. 21, 2018**

(54) SCRUBBING DEVICE WITH A PROTECTIVE HANDLE

(71) Applicant: American Invented Products, Inc., West Dundee, IL (US)

(72) Inventor: Kenneth J. Konkey, West Dundee, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/390,644

(22) Filed: Dec. 26, 2016

(65) Prior Publication Data

US 2017/0105593 A1 Apr. 20, 2017

Related U.S. Application Data

(63) Continuation-in-part of application No. 14/684,263, filed on Apr. 10, 2015, now Pat. No. 9,526,392.

(51) Int. Cl.
*A47L 13/022* (2006.01)
*A47L 13/07* (2006.01)
(Continued)

(52) U.S. Cl.
CPC ..... *A47L 13/022* (2013.01); *A47K 7/02* (2013.01); *A47L 13/04* (2013.01); *A47L 13/07* (2013.01);
(Continued)

(58) Field of Classification Search
CPC ..... A47L 13/022; A47L 13/04; A47L 13/06; A47L 13/07; A47L 13/10; A47L 13/16;
(Continued)

(56) References Cited

U.S. PATENT DOCUMENTS 1,821,505 A * 9/1931 Field ..... A47L 13/022 15/229.13
1,905,307 A * 4/1933 Schulhoff ..... A47L 13/022 15/229.13
(Continued)

FOREIGN PATENT DOCUMENTS

| | | |
|---|---|---|
| FR | 1543656 | * 10/1968 |
| FR | 2958525 | * 10/2011 |
| JP | 2013-202398 | * 10/2013 |

OTHER PUBLICATIONS

Partial machine translation, FR 1543656, Oct. 25, 1968.*
Partial machine translation, JP 2013-202398, Oct. 7, 2013.*

*Primary Examiner* — Mark Spisich
(74) *Attorney, Agent, or Firm* — Crawford IP Law LLC; Brie A. Crawford

(57) ABSTRACT

A scrubbing device with a protective handle is disclosed by this invention. The protective handle protects the fingernails, knuckles and digits of a user during use. The protective handle is flexible and malleable. The user grips the protective handle and rolls it over their fingernails, digits, upper knuckles and lower knuckles and tucks their thumb either behind or in front of the handle. The protective handle then protects the user's fingernails, knuckles and digits during use. The scrubbing device with a protective handle may have a protective pad or a protective coating. The scrubbing device with a protective handle may have an attached scouring accessory. Or, the scrubbing device with a protective handle may have a protective pad or a protective coating and an attached scouring accessory.

17 Claims, 10 Drawing Sheets

(51) Int. Cl.

| | |
|---|---|
| ***A47L 13/16*** | (2006.01) |
| ***A47K 7/02*** | (2006.01) |
| ***B24D 15/04*** | (2006.01) |
| ***A47L 13/04*** | (2006.01) |
| ***B25G 1/00*** | (2006.01) |

(52) U.S. Cl.
CPC ..... *A47L 13/16* (2013.01); *B24D 15/04* (2013.01); *B25G 1/00* (2013.01); *A45D 2200/1054* (2013.01)

(58) Field of Classification Search
CPC ..... A47K 7/02; B24D 15/00; B24D 15/04; A45D 33/36; A45D 37/00; A45D 40/26; A45D 40/28; A45D 2200/10; A45D 2200/1009; A45D 2200/1054; A45D 2200/1063
USPC ..... 15/118, 209.1, 210.1, 220.3, 229.11, 15/229.13, 244.1, 244.3, 244.4; 132/320; 451/354, 523–525, 557, 558, 539; D8/90, D8/94; D28/63; D32/40, 42, 43, 51, 52
See application file for complete search history.

(56) References Cited

U.S. PATENT DOCUMENTS

| | | | | | |
|---|---|---|---|---|---|
| 2,012,500 | A | * | 8/1935 | Ebert | A47L 13/04 15/229.13 |
| 2,058,213 | A | * | 10/1936 | Cannonito | A47L 13/022 15/229.13 |
| 2,479,131 | A | * | 8/1949 | Pari | A47L 13/022 15/229.13 |
| 2,954,772 | A | * | 10/1960 | Lebert | A24F 13/04 131/187 |
| 3,570,036 | A | * | 3/1971 | Gilchrist et al. | A47L 17/08 15/104.94 |
| 4,506,404 | A | * | 3/1985 | Clay | A47L 13/16 15/218.1 |
| D351,696 | S | * | 10/1994 | Adolf | D28/63 |
| D356,408 | S | * | 3/1995 | Adolf | D28/63 |
| 7,610,647 | B2 | * | 11/2009 | Morgan | A47L 13/17 15/104.94 |

* cited by examiner

SCRUBBING DEVICE WITH A PROTECTIVE HANDLE

CROSS REFERENCE TO RELATED APPLICATION AND INCORPORATION BY REFERENCE

This application is a continuation-in-part of previously filed United States of America Utility patent application titled PROTECTIVE HANDLE FOR A SCRUBBING DEVICE, with an application filing date of Apr. 10, 2015, in the United States Patent and Trademark Office, application Ser. No. 14/684,263, U.S. Pat. No. 9,526,392.

BACKGROUND OF THE INVENTION

This invention relates to a scrubbing device with a protective handle and more particularly to a scrubbing device with a protective handle which is malleable and flexible and protects and conceals the fingernails, knuckles and digits from harm or damage while the scrubbing device is being used.

There are a wide variety of commercially available scrubbing devices on the market. These scrubbing devices are used to scrub and clean everything from dishes, floors, sinks and household surfaces to more industrial applications such as gasoline and diesel engines. Moreover, these scrubbing devices can be used for cosmetic or personal care purposes such as skin exfoliation, back scratching and to clean other body parts. These scrubbing devices can also be used for light to heavy industrial purposes such as sanding wood or drywall or finishing the surfaces of metals, plastics, ceramics or other materials.

In cleaning any surface, generally, force ranging from mild to vigorous pressure must be applied to the scrubbing device in order to effectively scrub, sand or finish. However, scrubbing, sanding or finishing a surface usually exposes the fingernails, knuckles and digits to the surface and other elements in the external environment. The force and speed of the back and forth and/or circular movement can cause damage or injury to the fingernails, knuckles and digits. Depending on the use, the back and forth and/or circular movement can expose the fingernails, knuckles and digits to potential sharp or dangerous surfaces or conditions and potential injury. Also, in the case of cosmetic or personal hygiene purposes, the user's fingernails can cause damage to the body part that is being cleaned or where makeup is being applied. A scrubbing device with a protective handle that protects the fingernails, knuckles, digits and other body parts during use is a useful invention.

A scrubbing device is generally necessary on a daily basis to bathe, do dishes, scrub floors and complete other routine household, industrial or personal hygiene tasks. A manicure can cost hundreds of dollars and can be easily ruined by the back and forth motion and/or circular motion of scrubbing dishes, cleaning engines or bathing. Also, external elements, sharp objects and unintentional contact can break fingernails and ruin a manicure. A scrubbing device with a protective handle that allows the manicured fingernails to be protected and concealed during use is a useful invention.

A scrubbing device is useful for cleaning automobile engines, sanding or finishing surfaces or other industrial purposes. However, when using a scrubbing device to clean, sand or finish for industrial purposes, the digits, nails and knuckles are exposed to sharp or other potentially harmful surfaces. A scrubbing device with a protective handle that protects and conceals the nails, knuckles and digits from harm during use is a useful invention.

Currently, gloves exist that are used to protect and conceal the fingernails, knuckles and digits during use. However, these gloves are made of latex or other synthetic materials that can cause allergic reactions in the user. These gloves also provide limited protection and concealment from external elements and can be punctured by sharp objects. A scrubbing device with a protective handle that allows the fingernails, knuckles and digits to be protected and concealed during use without the problems caused by gloves is a useful invention.

There are scrubbing devices on the market with handles. However, these handles tend to be rigid and unbending and serve more to aid in gripping than to protect and conceal the fingernails, knuckles and digits during use. A scrubbing device that has a protective and flexible handle that is adjustable to aid in protection and concealment during use is a useful invention.

SUMMARY OF THE INVENTION

Among the many objectives of the present invention is the provision of a scrubbing device with a protective handle where the handle is flexible.

Yet another objective of the present invention is the provision of a scrubbing device with a protective handle where the handle is of sufficient length to protect and conceal the nails, knuckles and digits during use.

A further objective of the present invention is the provision of a scrubbing device with a protective handle where the handle can be rolled to cover the fingernails, knuckles and digits during use.

Moreover, another objective of the present invention is the provision of a scrubbing device with a protective handle where the scrubbing device base can be used as a handle and the protective handle can be used as a scrubbing device to clean in between tight surfaces.

A still further objective of the present invention is the provision of a scrubbing device with a protective handle where the scrubbing device base can have an attached layer of abrasive or scouring material to allow the scrubbing device to scour tough surfaces.

Also, an objective of the present invention is the provision of a scrubbing device with a protective handle where the scrubbing device base can have an attached abrasive, scouring or finishing material to allow the scrubbing device to sand or finish wood or other hard surfaces.

Another objective of the present invention is the provision of a scrubbing device with a protective handle which has an edge cleaning position so that the base of the scrubbing device and the protective handle can be used to clean the surface and edge of an object simultaneously.

Moreover, an objective of the present invention is the provision of a scrubbing device with a protective handle which has a protective handle which has enough rigidity to control movement of the scrubbing device over an object or surface.

A still further objective of the present invention is the provision of a scrubbing device with a protective handle which has a protective handle which is bendable in either lateral direction so that a right-handed and left-handed user can easily use the scrubbing device.

Yet, another objective of the present invention is the provision of a scrubbing device with a protective handle where the scrubbing device is useful for cosmetic or personal care purposes to protect the user's body from accidental harm from the fingernails when scrubbing body parts.

These and other objectives of the invention (which other objectives become clear by consideration of the specification, claims and drawings as a whole) are met by providing a scrubbing device with a protective handle which is flexible yet protective.

BRIEF DESCRIPTION OF THE DRAWINGS

Throughout the figures of the drawings, where the same part appears in one or more than one figure of the drawings, the same number is applied thereto.

DESCRIPTION OF THE PREFERRED EMBODIMENTS

Figure 1:
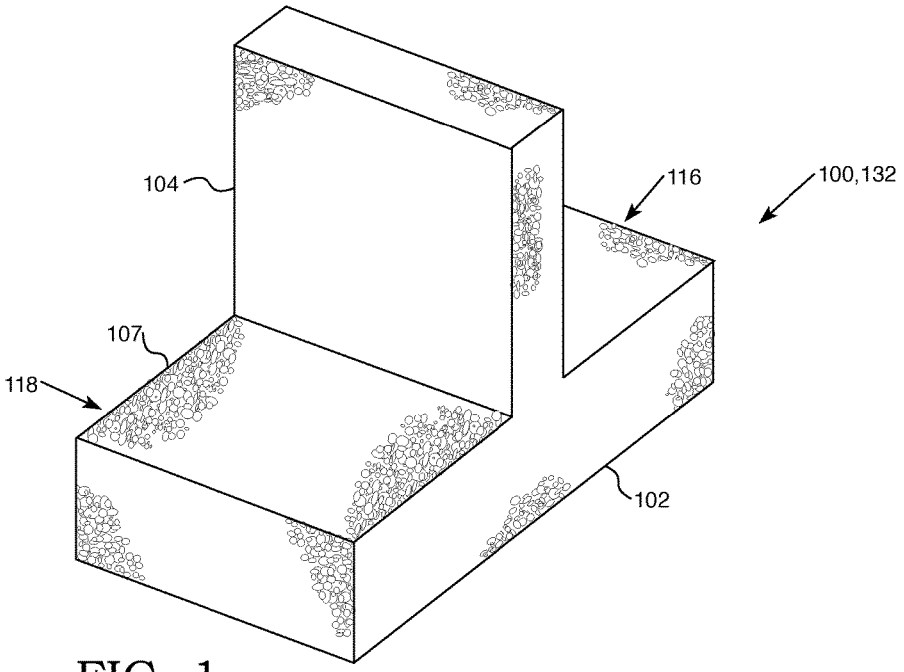
FIG. 1 depicts a top perspective view of the scrubbing device with a protective handle 100 of this invention.

Reference will now be made in detail to several embodiments of the invention that are illustrated in the accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, over, above, below, beneath, rear and front, may be used with respect to the drawings. These and similar directional terms are not to be construed to limit the scope of the invention in any manner. The words attach, connect, couple and similar terms with their inflectional morphemes do not necessarily denote direct or intermediate connections, but may also include connections through mediate elements or devices.

A scrubbing device with a protective handle is provided. The protective handle and scrubbing device can be a unitary piece. Also, the protective handle can be a separate piece and attached to the scrubbing device through glue, fusion by heating, or any other suitable fastener or attachment method. The protective handle is a flexible handle. The protective handle is flexible and bendable in either lateral direction. The user grips the protective handle and rolls it over their fingernails, digits, upper knuckles and lower knuckles and tucks their thumb either behind or in front of the handle. The user can then use the scrubbing device on a multitude of surfaces and reduce or prevent damage to their digits, knuckles and fingernails.

The scrubbing device can have one or more surfaces suitable for scrubbing. The scrubbing device can have one or more surfaces suitable for scouring. The scrubbing device can have one or more surfaces suitable for scrubbing and one or more surfaces suitable for scouring at the same time.

A surface suitable for scrubbing is intended to remove material present on the surface of the object to be scrubbed without significantly abrading or scratching the surface of the object to be scrubbed or removing more than minor amounts of material comprising the object to be scrubbed. Material affixed to the base or the protective handle which is meant to provide a surface suitable for scrubbing forms a scrubbing pad. A scrubbing pad which can be operably attached and removed by the user in normal use is a scrubbing accessory.

A surface suitable for scouring is intended to remove material which has chemically or physically bonded with the surface of the object to be scrubbed and will significantly abrade, scratch or remove more than minor amounts of material from the object to be scrubbed. Material affixed to the base or the protective handle which is meant to provide a surface suitable for scouring forms a scouring pad. A scouring pad which can be operably attached and removed by the user in normal use is a scouring accessory.

The scrubbing device can be a multitude of different products. The scrubbing device can be a loofah, pumice stone or a natural sea sponge for cosmetic or personal care purposes. The scrubbing device can be a sponge, steel wool or abrasive pad for household cleaning purposes. The scrubbing device can be copper wool, steel wool or an abrasive impregnated fabric for industrial purposes. The scrubbing device can have sandpaper, steel wool, steel screen or abrasives attached to the bottom for dry walling or carpentry purposes. The scrubbing device can be composed of and/or have silicone scrubbing materials affixed. The scrubbing device can be composed of and/or have a (cellular) ester foam material with closed cells, open cells, or a combination of both open and closed cells affixed. This disclosure is meant to be exemplary of suitable scrubbing devices but is not meant to limit the scrubbing devices to these examples and any suitable scrubbing device for any suitable purpose is included in and encompassed by this disclosure.

The scrubbing device can be made of any suitable material. The material of the scrubbing device can be hydrophilic or hydrophobic. The scrubbing device can be made of synthetic materials such as cellulose or cellulose wood fibers, foamed plastic polymers, open-cell or closed-cell foam materials, open-cell mixed with closed-cell foam materials, polyurethane foam, expanded polypropylene foam, expanded polyethylene foam, melamine foam, a low-density polyether, a polyvinyl alcohol, polyethylene or a plastic or plastic composite. The scrubbing device can be made of thermochromic polyurethane foam or polyurethane foam or thermochromic foam. The scrubbing device can be made of a foam or sponge material that is more rigid and less flexible at lower temperatures and less rigid and more flexible at higher temperatures. Moreover, the scrubbing device can be made of natural or organic materials such as a loofah, latex, a natural rubber or a natural sea sponge. The scrubbing device can be made of a reticulated foam material. This disclosure is meant to be exemplary of suitable materials for the scrubbing device but is not meant to limit the materials to these examples and any suitable material is included in and encompassed by this disclosure.

The protective handle can be made of any suitable material. The material of the protective handle can be the same material as the scrubbing device or the protective handle can be made of a different material than the scrubbing device. The protective handle can be made of synthetic materials such as cellulose wood fibers, foamed plastic polymers, open-cell or closed-cell foam materials, a low-density polyether or a polyvinyl alcohol. The protective handle can be made of a reticulated foam material.

The protective handle must be made of a material that is flexible, malleable and bendable and can be gripped and rolled down over the fingernails, knuckles and digits of the user with the thumb tucked either in front of or behind the handle. Protective handles being flexible, malleable and bendable in this manner, for purposes of this application, are referred to as "rollable." While human hands come in a range of sizes and have a range of mobility, for a protective handle to be rollable as used herein requires that the protective handle be flexible enough that the average human being can roll the protective handle sufficiently to protect their fingernails, knuckles, and digits as described herein without requiring undue force, causing discomfort or distending the scrubbing device to the point where it cannot be efficiently used as described herein.

The material must also be rigid enough to allow the protective handle to control the direction of the scrubbing device during use. The material must also be strong and durable enough to protect and conceal the fingernails, knuckles and digits of a user from the back and forth and/or circular motion of scrubbing and contact with sharp objects and other dangerous factors in the external environment. However, the material must not be too abrasive or rough as to harm the user's fingernails, knuckles or digits during use or suitable optional attachments must be used for protection. This disclosure is meant to be exemplary of suitable materials for the protective handle but is not meant to limit the materials to these examples and any suitable material is included in and encompassed by this disclosure.

The scrubbing device can be the rectangular scrubbing device as seen in the accompanying drawings. However, the scrubbing device can vary in shape and size depending on the purpose for which it is used. A smaller and round scrubbing device may be used for personal hygiene or cosmetic uses. A triangular shaped scrubbing device may be used for detail work or scrubbing or sanding. The scrubbing device may be a square, a wedge or a polygon for suitable situations. A larger scrubbing device may be used for industrial purposes while a smaller scrubbing device may be used for household or cosmetic purposes. This disclosure is meant to be exemplary of suitable shapes and sizes for the scrubbing device but is not meant to limit the shape or size to these examples and any suitable shape or size is included in and encompassed by this disclosure.

The protective handle can be any shape or size to fit the underlying scrubbing device as long as the handle is long enough to be rolled to protect the fingernails, knuckles and digits of the user during use. Protective handles having a handle length long enough to be rolled in this manner, for purposes of this application, are referred to as having an "extended handle length." While human hands come in a range of sizes, an extended handle length as used herein requires that the average human being can roll the protective handle sufficiently to protect their fingernails, knuckles and digits as described herein.

In the embodiments depicted, the scrubbing device is shown as being used with one hand. However, for larger scrubbing devices, the protective handle may be large enough to accommodate and protect both hands during use. The two handed protective handle functions in the same manner as depicted below in the drawings with the user placing both hands over the handle and rolling it downward and tucking their thumbs behind the handle for protection.

Figure 2:
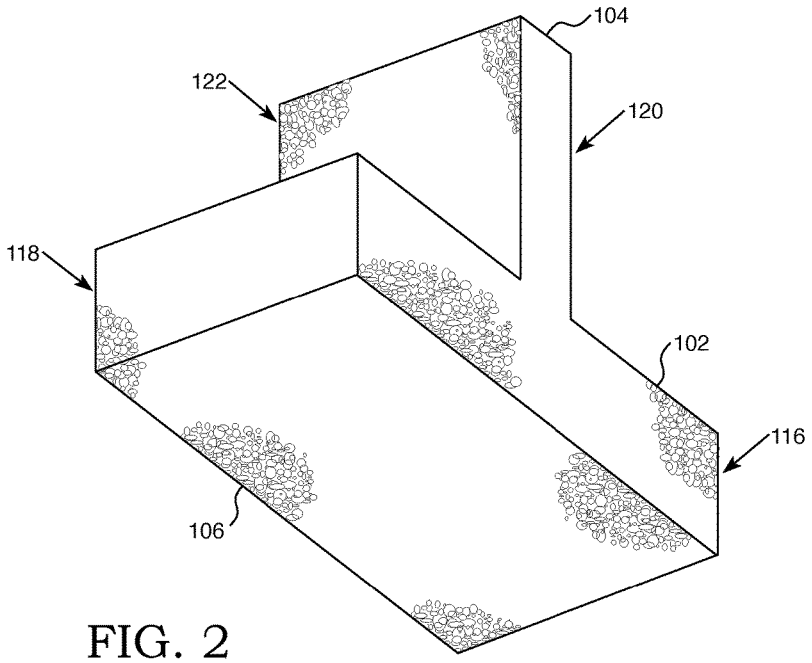
FIG. 2 depicts a bottom perspective view of the scrubbing device with a protective handle 100 of this invention.

Now adding FIG. 1 and FIG. 2 to the consideration, a scrubbing device with a protective handle 100 of this invention can be clearly seen. Scrubbing device with a protective handle 100 has protective handle 104 attached to base 102. Protective handle 104 is in extended position 132. Base 102 can be any desired shape, size or thickness. For purposes of this application, the protective handle 104 is said to be in an "extended position" when it is in its usual shape prior to any movement, bending or rolling by the user.

Figure 3:
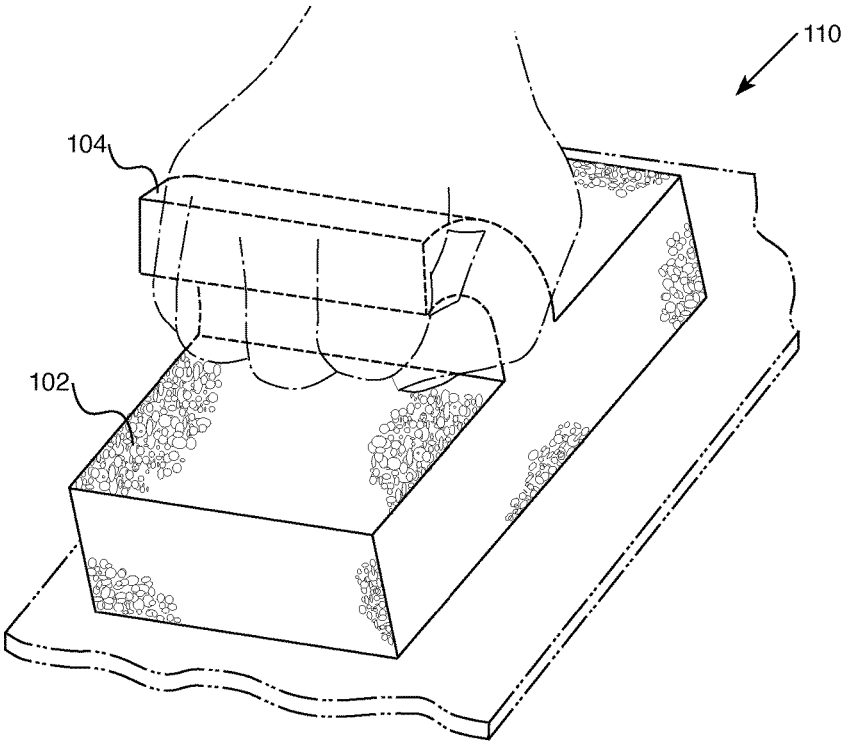
FIG. 3 depicts a top perspective view of the scrubbing device with a protective handle 100 in protective position 110 with the hand of the user depicted in phantom and the protective handle 104 partially depicted in phantom.
Figure 4:
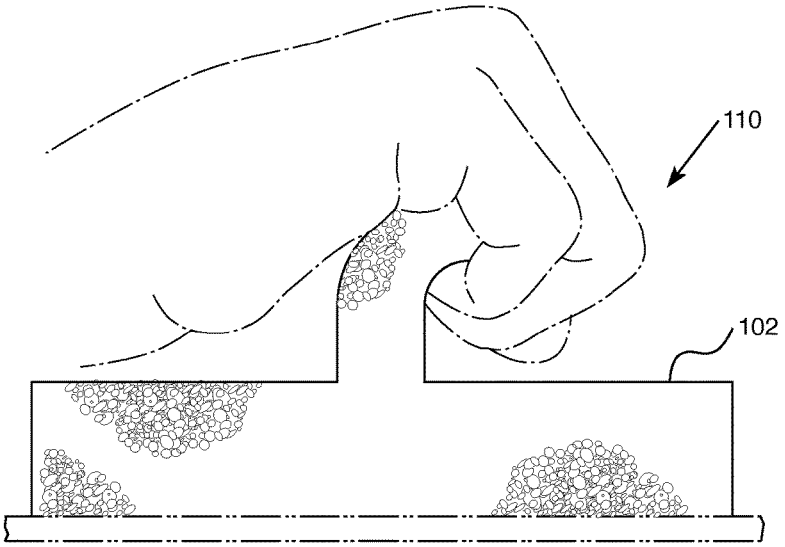
FIG. 4 depicts a side plan view of the scrubbing device with a protective handle 100 in protective position 110 with the hand of the user depicted in phantom.
Figure 6:
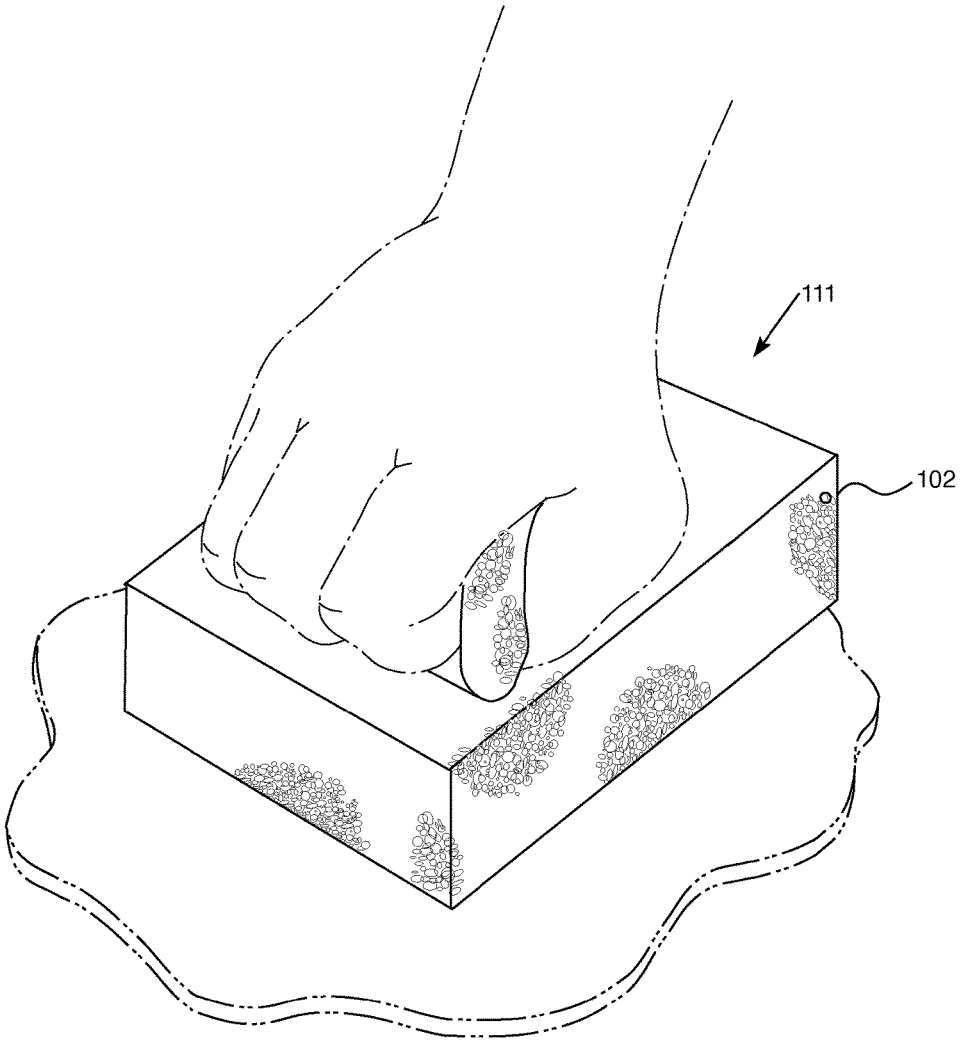
FIG. 6 depicts a top perspective view of the scrubbing device with a protective handle 100 in second protective position 111 with the hand of the user and the surface 130 depicted in phantom.

Now adding FIG. 3, FIG. 4 and FIG. 6 to the consideration, the protective positions 110 and 111 of protective handle 104 can be clearly seen. Protective handle 104 is a flexible and bendable material. Protective handle 104 can be gripped by the user and rolled downward providing a protective and concealment barrier for the fingernails, knuckles and digits of the user. For purposes of this application, the protective handle 104 is said to be in a "protective position" when it has been rolled around the digits of the user in such a manner as to substantially shield the fingernails and/or knuckles of the user from contact with the material to be scrubbed and/or the debris from the scrubbing process.

The length of protective handle 104 is an important feature of the invention. Protective handle 104 must be of sufficient extended length 124 to allow a user with any hand size to grip handle 104 and roll it downward and still have the fingernails, knuckles and digits protected and concealed by handle 104 during use. In the preferred embodiment, the extended length 124 of protective handle 104 is 1.27 centimeters (0.5 inches) to 25.4 centimeters (10 inches). In a more preferred embodiment, the extended length 124 of protective handle 104 is 5.08 centimeters (2 inches) to 20.32 centimeters (8 inches). In the most preferred embodiment, the extended length 124 of protective handle 104 is 7.62 centimeters (3 inches) to 12.7 centimeters (5 inches).

In a first embodiment of protective position 110, as seen in FIG. 3, the user grips the protective handle 104 by placing the second, third, fourth and fifth digits in front of the protective handle 104. The user then rolls the protective handle 104 downward and wraps the first digit around a side of the handle 104 and then places it underneath the second digit for protection. Protective handle 104, in protective position 110, then protects and conceals the nails, knuckles and digits of all five digits during use.

In a second embodiment of protective position 111, as seen in FIG. 6, the user grips the protective handle 104 by placing the second, third, fourth and fifth digits in front of the protective handle 104. The user then rolls the handle 104 downward and places the first digit or thumb beneath the protective handle 104 thereby protecting and concealing the nails, knuckles and digits of all five digits during use. The only difference between FIG. 3 and protective position 110 and FIG. 6 and second protective position 111 is the placement of the first digit.

Figure 5:
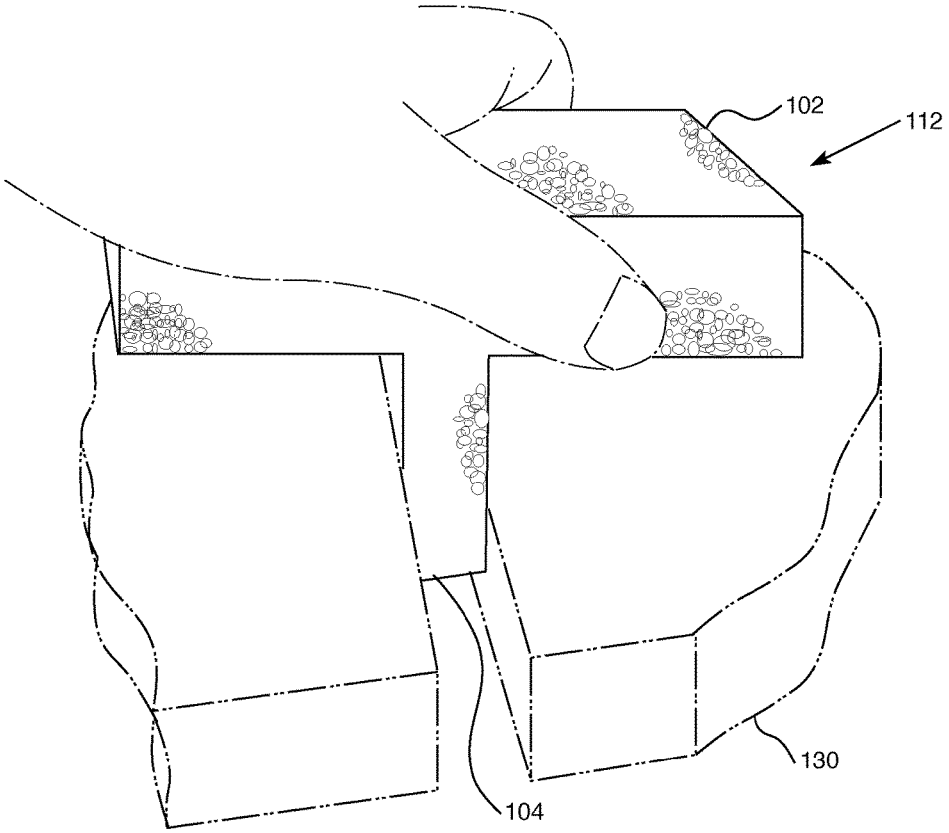
FIG. 5 depicts an inverted perspective view of the scrubbing device with a protective handle 100 in crevice cleaning position 112 with the hand of the user and the surface 130 depicted in phantom.

Now adding FIG. 5 to the consideration, the crevice cleaning position 112 of scrubbing device with a protective handle 100 can be seen. Base 102 can be used to grip while protective handle 104 can be used to clean. This feature is especially useful when scrubbing device with a protective handle 100 is being used to clean a tight place such as crevices between two surfaces 130. An example of this can be a space between a kitchen appliance, such as a stove, and a counter. Other examples can be for cleaning between spaced wooden or plastic slats of lawn or outdoor furniture and indoor furniture, grill grates, sewer grates, shower grates, drainage grates, louvers or slats in vertical or horizontal blinds, the lower frame of a sliding patio door and toilet bowls. For purposes of this application, the protective handle 104 is said to be in a "crevice cleaning position" when the user is gripping base 102 and using protective handle 104 to scrub a surface. If using the device 100 in a crevice cleaning position, it is required that protective handle 104 be made of a suitable material or have a suitable outer surface or accessory to tolerate being used as a scrubbing tool without being easily damaged in normal use.

Figure 7:
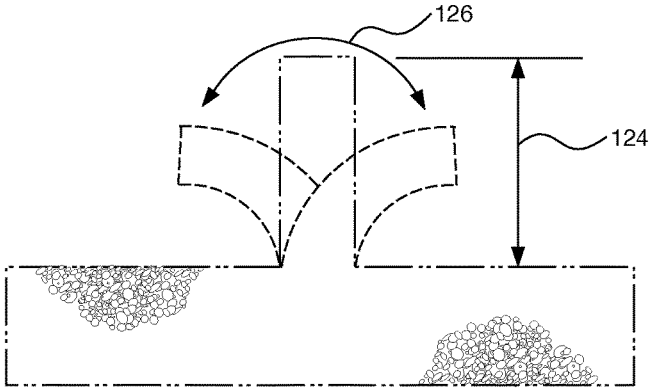
FIG. 7 depicts a side plan view of the scrubbing device with a protective handle 100 with left or right lateral movement 126 of protective handle 104 depicted in phantom.

Now adding FIG. 7 to the consideration, right or left lateral movement 126 of protective handle 104 can be clearly seen. Protective handle 104 has lateral movement 126 in either the right or left direction. Right or left lateral movement 126 is important to allow a user that is either right-handed or left-handed to grip protective handle 104 and place it in protective positions 110 or 111. Thus, right or left lateral movement 126 allows a user that is either right-handed or left-handed to comfortably grip protective handle 104 and apply the proper force to base 102 to effectively scrub the desired surface.

Figure 8:
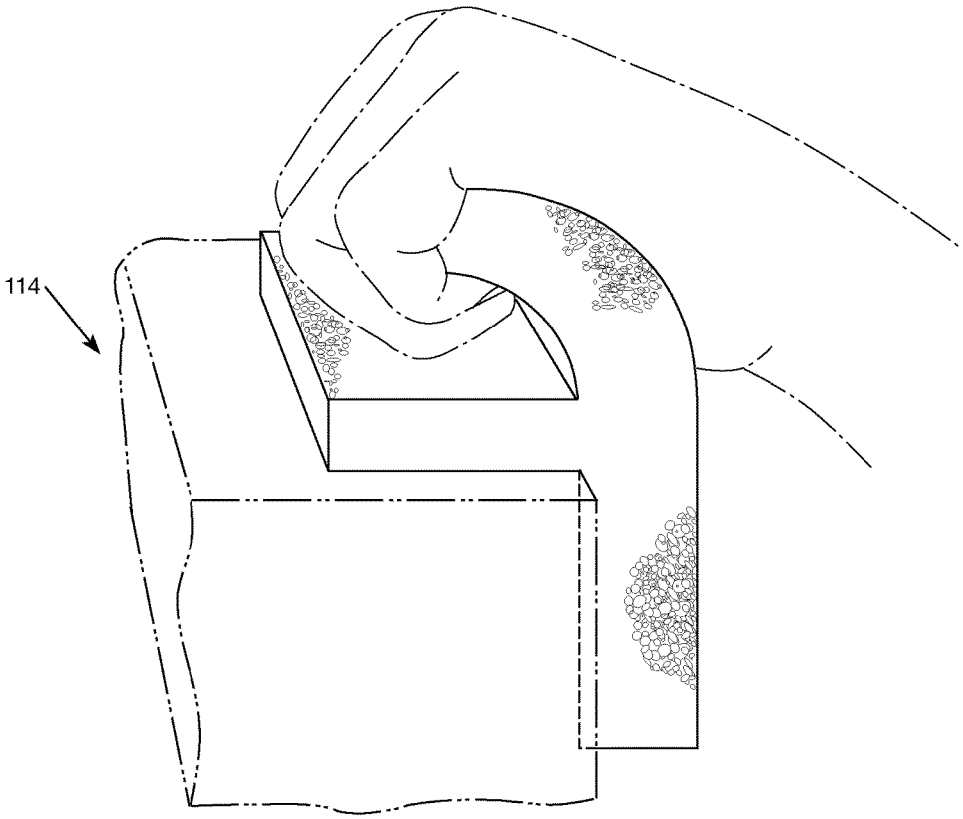
FIG. 8 depicts a top perspective view of the scrubbing device with a protective handle 100 in edge scrubbing position 114 with the hand of the user and the surface 130 depicted in phantom.

Now adding FIG. 8 to the consideration, edge scrubbing position 114 of scrubbing device with a protective handle 100 can be clearly seen. In edge scrubbing position 114, the top or bottom and edge of a surface or object can be cleaned simultaneously. For purposes of this application, the protective handle 104 is said to be in an "edge cleaning position" when the 355 user is gripping base 102 by either the right side or the left side of the base 102 and using protective handle 104, and the side of base 102 which is not being gripped, to scrub a surface 130 having at least two sides with an edge between them. Thus, the angle between protective handle 104 and the side of base 102 which is not being gripped is in contact with the edge of the 360 surface 130. If using the device in an edge scrubbing position 114, it is required that protective handle 104 be made of a suitable material or have a suitable outer surface to tolerate being used as a scrubbing tool without being easily damaged in normal use. It is further required that base 102 be rollable as described herein.

In edge scrubbing position 114, the user grips either a right side 116 or a left side 118 of base 102, placing the edge of the surface to be cleaned at or near the junction of the top side of base 102 and the right side 120 or the left side 122 of protective handle 104. The user then folds the protective handle 104 over the side opposite to the gripped side of the base 102. Thus, if the user grips the right side 116 of base 102, protective handle 104 is folded toward the left side 118 of base 102 and if the user grips the left side 118 of base 102, protective handle 104 is folded toward the right side 116 of base 102. Once gripped, the user then compresses the top and bottom surface of the object to be cleaned while moving the right side 116 or left side 118 of base 102 and the right side 120 or left side 122 of protective handle 104 laterally or circularly along all surfaces of the object to be cleaned. If the right or left side 120, 122 of protective handle 104 and the facing side of base 102 are equipped with a scouring surface or similar abrasive surface such as sandpaper, this will also allow the creation of symmetrically finished edge surfaces on the object to be cleaned and/or abraded.

Figure 9:
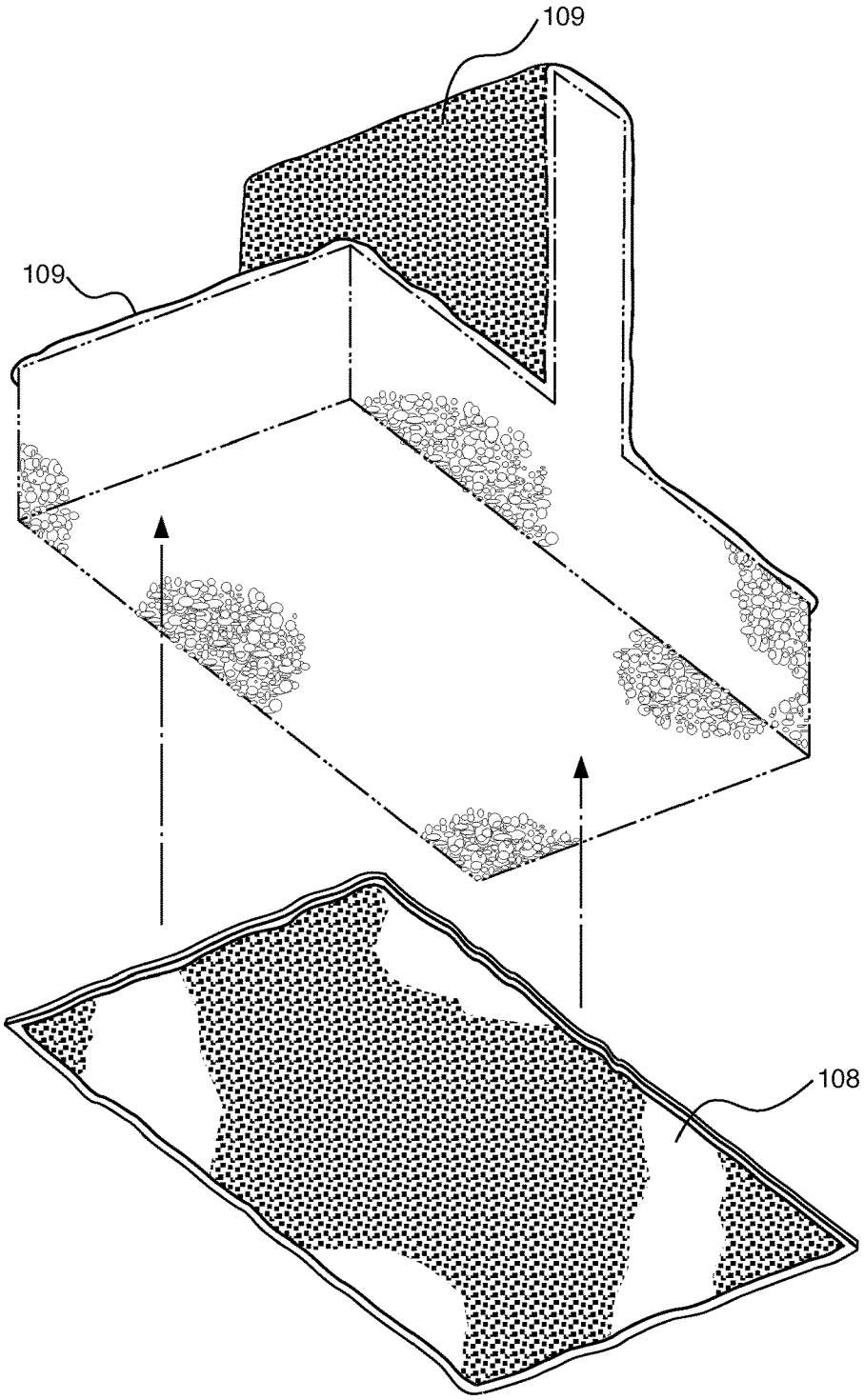
FIG. 9 depicts a bottom, exploded perspective view of the scrubbing device with a protective handle 100 with scouring accessory 108 and protective pad 109.

Now referring to FIG. 9, an additional embodiment of scrubbing device with a protective handle 100 can be clearly seen. In this embodiment, scrubbing device with a protective handle 100 is able to scour, sand or polish an object or a surface. In this embodiment, base 102 has bottom surface 106 which has a scouring accessory 108. Scouring accessory 108 can be shells, corn cobs, loofahs, sand papers, composite chips, polyethylene, concrete, pumice or volcanic rocks, slags, aluminum oxides, steel wools, abrasive plastic aggregates, abrasive metals, silicon carbide, garnet, a plastic or a plastic composite or a woven fabric of any material composition impregnated with an abrasive compound. Scouring accessory 108 allows base 102 to be used for household purposes such as scrubbing dishes, appliances or bathroom fixtures, light industrial applications such as sanding of metal, wood or drywall or heavy industrial purposes such as cleaning car engines or other machinery.

As an alternate embodiment, scouring accessory 108 can be the material of base 102 itself, creating a scouring pad. The material of base 102 can range in hardness from a loofah material with progressing levels of hardness and abrasiveness to include metals or metal alloys or a scrubbing device impregnated with abrasive substances up to the hardness of cubic zirconia.

In this embodiment, it may be necessary to add an additional protective pad 109 to both the left side 122 and right side 120 of protective handle 104 and the top 107 of base 102. This protective pad 109 protects the fingernails, knuckles and digits from the abrasiveness of base 102 while in the protective position 110 or 111. For purposes of this application, a "protective pad" refers to any pad or other material or coating which covers part or all of the protective handle 104 and/or the upper surfaces (those perpendicularly opposed to protective handle 104 and forming an angle with the sides of protective handle 104) of base 102. The protective pad 109 can be made of any suitable material such as felt, cotton, or synthetic material that is strong enough to provide a barrier between the abrasive nature of the base 102 and the fingernails, knuckles and digits of the user, yet still protect the fingernails, knuckles and digits during use. Protective pad 109 may be made of either a material designed to absorb liquid or a material designed to shed liquid, as appropriate to any particular application.

Or, protective pad 109 can be a post-mold spray applicated coating (also referred to as a protective coating.) The flexible coating or the plastic coating can be vinyl based, polyurethane based, or acrylic based. One example of a suitable coating is available under the trade name Performix® and can be purchased at https://performixcoating-.com/foam-coatings. Performix® is a registered United States trademark, Registration Number 2,520,833, owned by Plasti Dip International, Inc., a corporation organized under the laws of the state of Minnesota, 3760 Flowerfield Road, Circle Pines, Minn., 55014. This disclosure is meant to be exemplary of suitable materials for protective pad 109 but is not meant to limit the materials to these examples and any material is included in and encompassed by this disclosure.

Protective pad 109 can be attached to base 102 and protective handle 104 through any suitable method. Some examples of suitable attachment methods for protective pad 109 include adhesives, a hook and loop assembly, thermal bonding or any other suitable method for providing a secure and stable attachment. This disclosure is meant to be exemplary of suitable attachment methods to attach protective pad 109 to base 102 and protective handle 104 but is not meant to limit the materials to these examples and any suitable attachment method for providing a secure and stable method is included in and encompassed by this disclosure.

Figure 10:
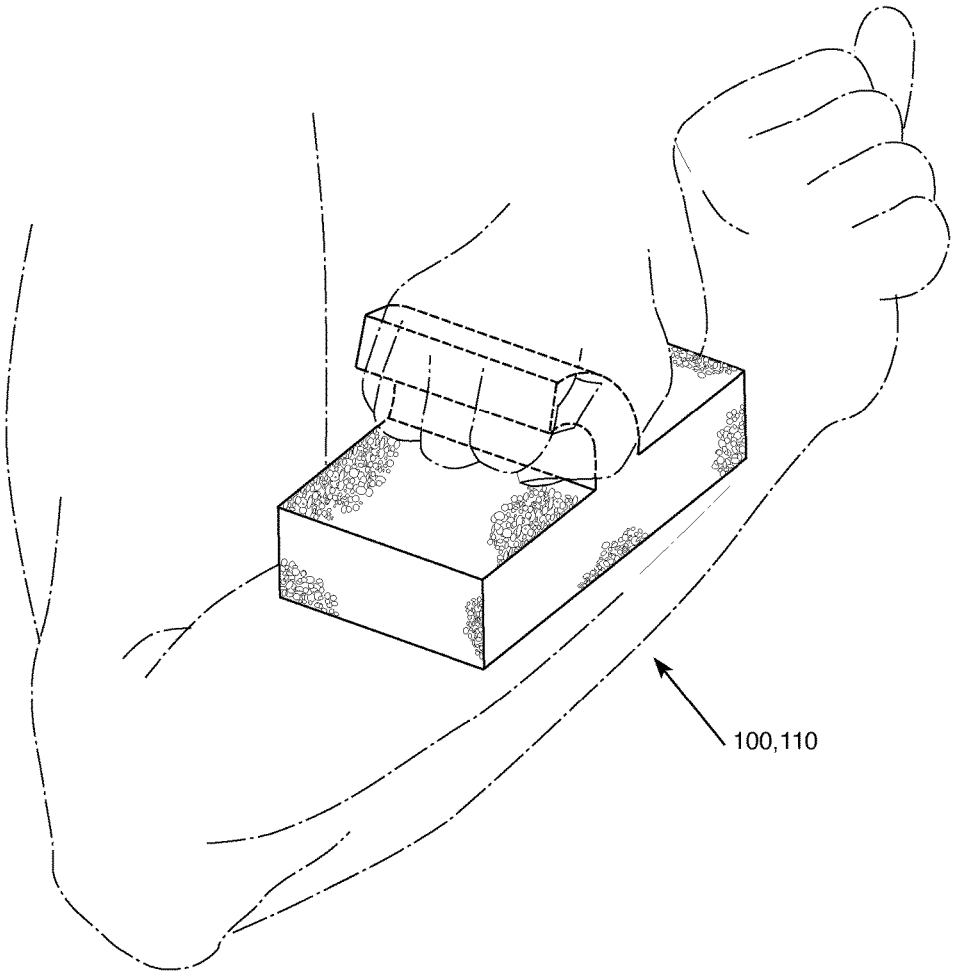
FIG. 10 depicts a top perspective view of the scrubbing device with a protective handle 100 in use on an arm with the arm depicted in phantom.

Now adding FIG. 10 to the consideration, the cosmetic or personal hygiene embodiment of a scrubbing device with a protective handle 100 can be clearly seen. In this embodiment, base 102 is for cosmetic or personal hygiene purposes such as exfoliating or cleaning the skin or scratching the back. In this embodiment, protective handle 104 must protect the fingernails, knuckles and digits of the user from harm during use but also must protect the body part that is being scrubbed from harm by the user's fingernails as well. The protective positions 110 and 111 as described above are applicable to this embodiment.

Figure 11:
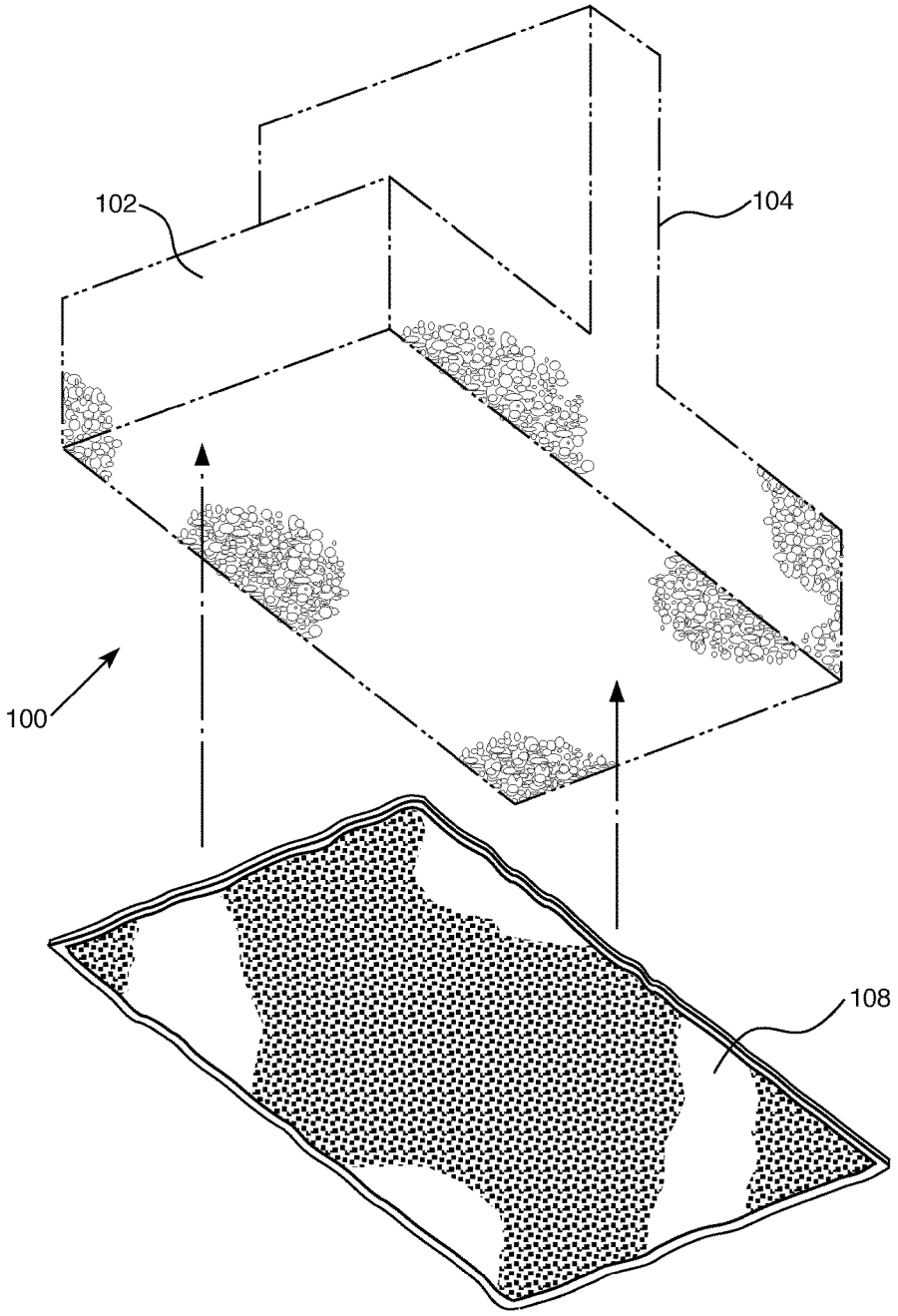
FIG. 11 depicts a bottom, exploded perspective view of the scrubbing device with a protective handle 100 with scouring accessory 108.

Now adding FIG. 11 to the consideration, another embodiment of a scrubbing device with a protective handle 100 can be clearly seen. In this embodiment only scouring accessory 108 is attached to the scrubbing device with a protective handle 100. The scouring accessory 108 is the same as described in FIG. 9.

With scouring accessory 108, base 102 can have multiple functions. First, the user can grasp protective handle 104 and use the scouring accessory 108 to scour an underlying surface or object. Then, the user can roll the base of the base 102 in such a manner that the top surface 107 of the base, having neither a scouring surface nor a protective coating 109 (not shown, see FIG. 9) is utilized to absorb excessive moisture or dislodged debris from the cleaned surface.

Figure 12:
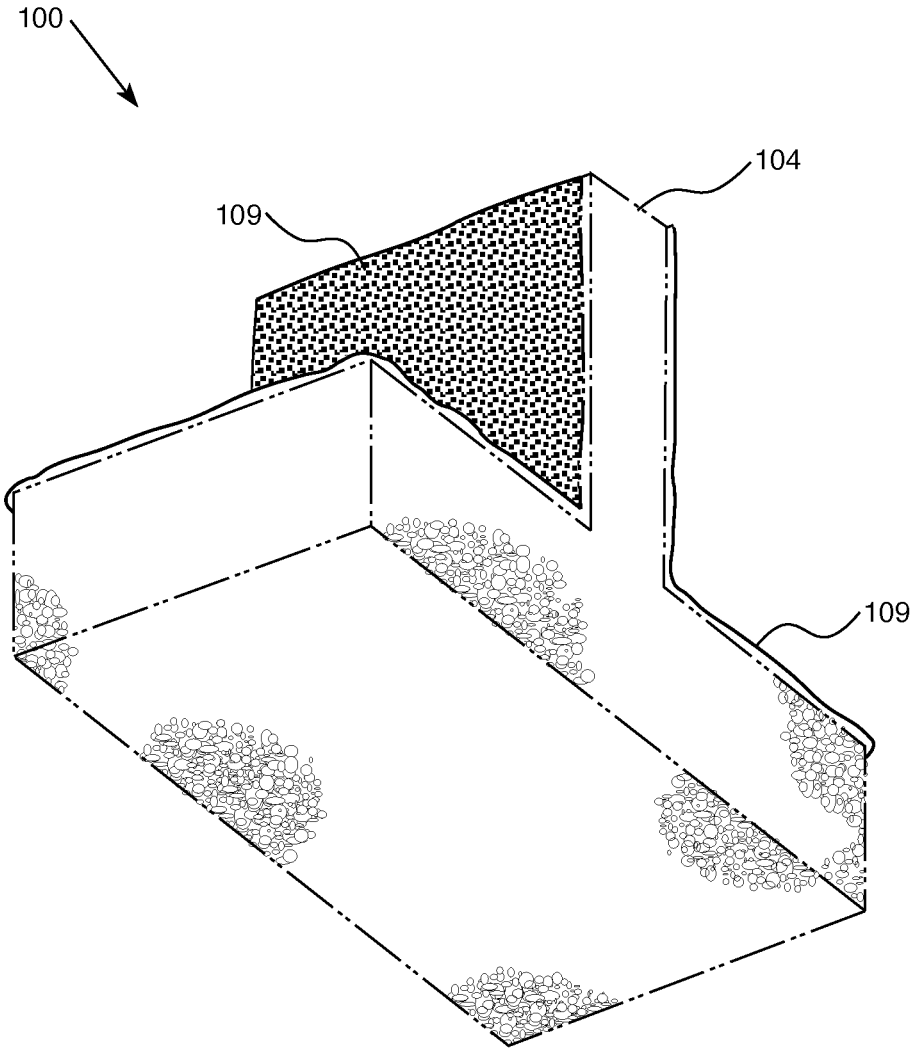
FIG. 12 depicts a bottom perspective view of the scrubbing device with a protective handle 100 with protective pad 109.

Now adding FIG. 12 to the consideration, another embodiment of a scrubbing device with a protective handle 100 can be clearly seen. In this embodiment, only protective pad 109 is attached to the scrubbing device with a protective handle 100. In this embodiment, protective pad 109 is two separate pieces and does not extend over the top of protective handle 104. In all other aspects, protective pad 109 is similar to that described in FIG. 9.

Figure 13:
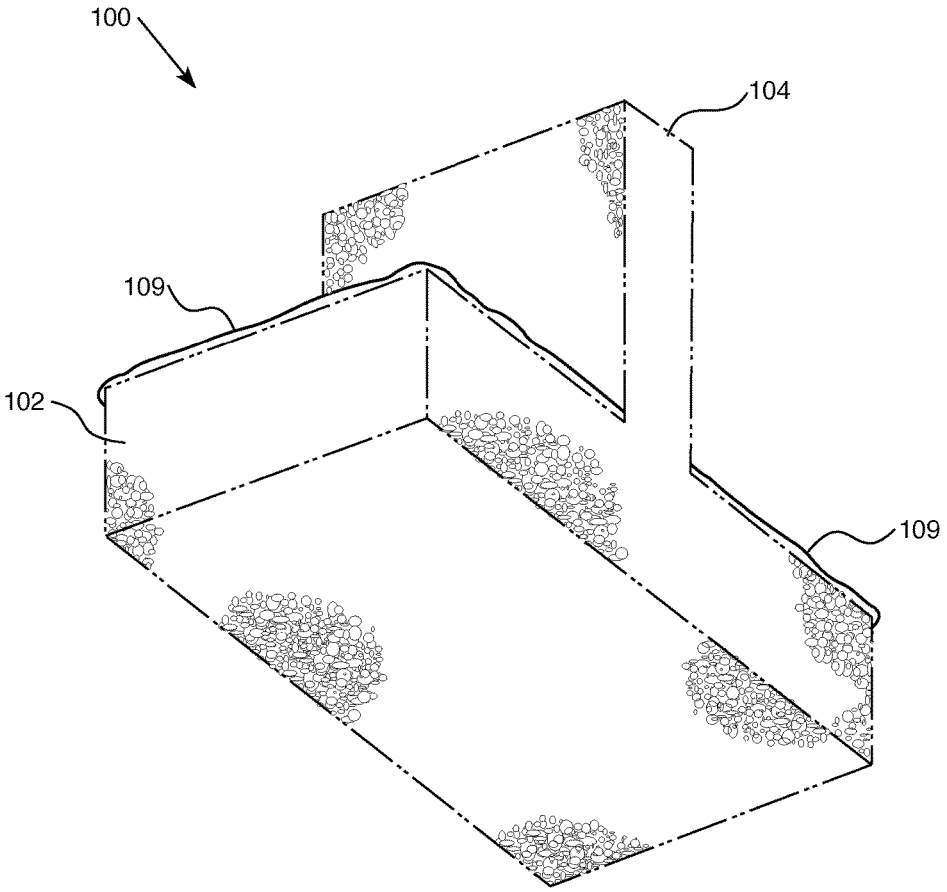
FIG. 13 depicts a bottom perspective view of the scrubbing device with a protective handle 100 with an alternate embodiment of protective pad 109.

Now adding FIG. 13 to the consideration, another embodiment of a scrubbing device with a protective handle 100 can be clearly seen. In this embodiment, only protective pad 109 is attached to the scrubbing device with a protective handle 100. In this embodiment, protective pad 109 is two separate pieces and does not extend onto protective handle 104, but covers only the surfaces of base 102 tangential to and facing protective handle 104. In all other aspects, protective pad 109 is similar to that described in FIG. 9.

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this tool can become clear to a person having ordinary skill in this particular art. Such modifications are clearly covered by this disclosure.

What is claimed and sought to be protected by Letters Patent is:

1. A scrubbing device comprising:

a) the scrubbing device having a base and a protective handle;

b) the base having a top surface and a bottom surface;

c) the protective handle extending upwardly from the base at a substantially perpendicular angle;

d) the protective handle extending upwardly from a substantially central portion of the base;

e) the protective handle being aligned with the base to form a t-shape;

f) the protective handle dividing the base into a left side and a right side;

g) the protective handle having an extended handle length;

h) the protective handle being flexible;

i) the protective handle being able to flex toward the base so as to cause the substantially perpendicular angle to become more acute toward the left side and more obtuse toward the right side;

j) the protective handle being rollable;

k) the protective handle being a single protective handle;

l) the protective handle having at least two substantially planar sides;

m) the protective handle having at least one protective pad; and n) the base having a scouring accessory attached to the bottom surface.

2. The scrubbing device of claim 1 wherein the protective pad is a protective coating.

3. A scrubbing device comprising:

a) the scrubbing device having a base and a protective handle;

b) the base having a top surface and a bottom surface;

c) the protective handle extending upwardly from the base at a substantially perpendicular angle;

d) the protective handle extending upwardly from a substantially central portion of the base;

e) the protective handle being aligned with the base to form a t-shape;

f) the protective handle dividing the base into a left side and a right side;

g) the protective handle having an extended handle length;

h) the protective handle being flexible;

i) the protective handle being able to flex toward the base so as to cause the substantially perpendicular angle to become more acute toward the left side and more obtuse toward the right side;

j) the protective handle being rollable;

k) the protective handle being a single protective handle;

l) the protective handle having at least two substantially planar sides;

m) the protective handle extending an entire width of the base;

n) the top surface and the bottom surface of the base being substantially planar;

o) the protective handle having a right side and a left side;

p) the protective handle having at least one protective pad; and q) the base having a scouring accessory attached to the bottom surface.

4. The scrubbing device of claim 3 wherein the protective pad is a protective coating.

5. A scrubbing device comprising:
a) the scrubbing device having a base and a protective handle;
b) the base having a top surface and a bottom surface;
c) the protective handle extending upwardly from the base at a substantially perpendicular angle;
d) the protective handle extending upwardly from a substantially central portion of the base;
e) the protective handle being aligned with the base to form a t-shape;
f) the protective handle dividing the base into a left side and a right side;
g) the protective handle having an extended handle length;
h) the protective handle being flexible;
i) the protective handle being able to flex toward the base so as to cause the substantially perpendicular angle to become more acute toward the left side and more obtuse toward the right side;
j) the protective handle being rollable;
k) the protective handle being a single protective handle;
l) the protective handle having at least two substantially planar sides;
m) the protective handle extending an entire width of the base;
n) the top surface and the bottom surface of the base being substantially planar;
o) the protective handle having a right side and a left side;
p) the top surface having a right top surface tangential and perpendicular to the right side of the protective handle;
q) the top surface having a left top surface tangential and perpendicular to the left side of the protective handle; and
r) wherein a first scouring accessory is affixed to the bottom surface, a second scouring accessory is affixed to the right top surface and the right side of the protective handle, and a third scouring accessory is affixed to the left top surface and the left side of the protective handle.

6. A scrubbing device comprising:
a) the scrubbing device having a base and a protective handle;
b) the base having a top surface and a bottom surface;
c) the protective handle extending upwardly from the base at a substantially perpendicular angle;
d) the protective handle extending upwardly from a substantially central portion of the base;
e) the protective handle being aligned with the base to form a t-shape;
f) the protective handle dividing the base into a left side and a right side;
g) the protective handle having an extended handle length;
h) the protective handle being flexible;
i) the protective handle being able to flex toward the base so as to cause the substantially perpendicular angle to become more acute toward the left side and more obtuse toward the right side;
j) the protective handle being rollable;
k) the protective handle being a single protective handle;
l) the protective handle having at least two substantially planar sides;
m) the protective handle extending an entire width of the base;
n) the top surface and the bottom surface of the base being substantially planar;
o) the protective handle having a right side and a left side;
p) the top surface having a right top surface tangential and perpendicular to the right side of the protective handle;
q) the top surface having a left top surface tangential and perpendicular to the left side of the protective handle; and
r) wherein a first scouring accessory is affixed to the bottom surface, and a second scouring accessory is affixed to the right top surface and the right side of the protective handle crossing over to the left side of the protective handle and the left top surface.

7. A scrubbing device comprising:
a) the scrubbing device having a base and a protective handle;
b) the base having a top surface and a bottom surface;
c) the protective handle extending upwardly from the base at a substantially perpendicular angle;
d) the protective handle extending upwardly from a substantially central portion of the base;
e) the protective handle being aligned with the base to form a t-shape;
f) the protective handle dividing the base into a left side and a right side;
g) the protective handle having an extended handle length;
h) the protective handle being flexible;
i) the protective handle being able to flex toward the base so as to cause the substantially perpendicular angle to become more acute toward the left side and more obtuse toward the right side;
j) the protective handle being rollable;
k) the protective handle being a single protective handle;
l) the protective handle having at least two substantially planar sides;
m) the protective handle extending an entire width of the base;
n) the top surface and the bottom surface of the base being substantially planar;
o) the protective handle having a right side and a left side;
p) the top surface having a right top surface tangential and perpendicular to the right side of the protective handle;
q) the top surface having a left top surface tangential and perpendicular to the left side of the protective handle; and
r) wherein a first scrubbing accessory is affixed to the bottom surface, a second scrubbing accessory is affixed to the right top surface and the right side of the protective handle, and a third scrubbing accessory is affixed to the left top surface and the left side of the protective handle.

8. A scrubbing device comprising:
a) the scrubbing device having a base and a protective handle;
b) the base having a top surface and a bottom surface;
c) the protective handle extending upwardly from the base at a substantially perpendicular angle;
d) the protective handle extending upwardly from a substantially central portion of the base;
e) the protective handle being aligned with the base to form a t-shape;
f) the protective handle dividing the base into a left side and a right side;
g) the protective handle having an extended handle length;
h) the protective handle being flexible;
i) the protective handle being able to flex toward the base so as to cause the substantially perpendicular angle to become more acute toward the left side and more obtuse toward the right side;

j) the protective handle being rollable;

k) the protective handle being a single protective handle;

l) the protective handle having at least two substantially planar sides;

m) the protective handle extending an entire width of the base;

n) the top surface and the bottom surface of the base being substantially planar;

o) the protective handle having a right side and a left side;

p) the top surface having a right top surface tangential and perpendicular to the right side of the protective handle;

q) the top surface having a left top surface tangential and perpendicular to the left side of the protective handle; and r) wherein a first scrubbing accessory is affixed to the bottom surface, and a second scrubbing accessory is affixed to the right top surface and the right side of the protective handle crossing over to the left side of the protective handle and the left top surface.

9. A scrubbing device comprising:

a) the scrubbing device having a base and a protective handle;

b) the base having a top surface and a bottom surface;

c) the protective handle extending upwardly from the base at a substantially perpendicular angle;

d) the protective handle extending upwardly from a substantially central portion of the base;

e) the protective handle being aligned with the base to form a t-shape;

f) the protective handle dividing the base into a left side and a right side;

g) the protective handle having an extended handle length;

h) the protective handle being flexible;

i) the protective handle being able to flex toward the base so as to cause the substantially perpendicular angle to become more acute toward the left side and more obtuse toward the right side;

j) the protective handle being rollable;

k) the protective handle being a single protective handle;

l) the protective handle having at least two substantially planar sides;

m) the protective handle extending an entire width of the base;

n) the top surface and the bottom surface of the base being substantially planar;

o) the protective handle having a right side and a left side;

p) the top surface having a right top surface tangential and perpendicular to the right side of the protective handle;

q) the top surface having a left top surface tangential and perpendicular to the left side of the protective handle; and r) wherein a first scrubbing accessory is affixed to the bottom surface, a first scouring accessory is affixed to the right top surface and the right side of the protective handle, and a second scouring accessory is affixed to the left top surface and the left side of the protective handle.

10. A scrubbing device comprising:

a) the scrubbing device having a base and a protective handle;

b) the base having a top surface and a bottom surface;

c) the protective handle extending upwardly from the base at a substantially perpendicular angle;

d) the protective handle extending upwardly from a substantially central portion of the base;

e) the protective handle being aligned with the base to form a t-shape;

f) the protective handle dividing the base into a left side and a right side;

g) the protective handle having an extended handle length;

h) the protective handle being flexible;

i) the protective handle being able to flex toward the base so as to cause the substantially perpendicular angle to become more acute toward the left side and more obtuse toward the right side;

j) the protective handle being rollable;

k) the protective handle being a single protective handle;

l) the protective handle having at least two substantially planar sides;

m) the protective handle extending an entire width of the base;

n) the top surface and the bottom surface of the base being substantially planar;

o) the protective handle having a right side and a left side;

p) the top surface having a right top surface tangential and perpendicular to the right side of the protective handle;

q) the top surface having a left top surface tangential and perpendicular to the left side of the protective handle; and r) wherein a first scrubbing accessory is affixed to the bottom surface, and a first scouring accessory is affixed to the right top surface and the right side of the protective handle crossing over to the left side of the protective handle and the left top surface.

11. A scrubbing device comprising:

a) the scrubbing device having a base and a protective handle;

b) the base having a top surface and a bottom surface;

c) the protective handle extending upwardly from the base at a substantially perpendicular angle;

d) the protective handle extending upwardly from a substantially central portion of the base;

e) the protective handle being aligned with the base to form a t-shape;

f) the protective handle dividing the base into a left side and a right side;

g) the protective handle having an extended handle length;

h) the protective handle being flexible;

i) the protective handle being able to flex toward the base so as to cause the substantially perpendicular angle to become more acute toward the left side and more obtuse toward the right side;

j) the protective handle being rollable;

k) the protective handle being a single protective handle;

l) the protective handle having at least two substantially planar sides;

m) the protective handle extending an entire width of the base;

n) the top surface and the bottom surface of the base being substantially planar;

o) the protective handle having a right side and a left side;

p) the top surface having a right top surface tangential and perpendicular to the right side of the protective handle;

q) the top surface having a left top surface tangential and perpendicular to the left side of the protective handle; and r) wherein a first scouring accessory is affixed to the bottom surface, a first scrubbing accessory is affixed to the right top surface and the right side of the protective handle, and a second scrubbing accessory is affixed to the left top surface and the left side of the protective handle.

12. A scrubbing device comprising:

a) the scrubbing device having a base and a protective handle;

b) the base having a top surface and a bottom surface;

c) the protective handle extending upwardly from the base at a substantially perpendicular angle;

d) the protective handle extending upwardly from a substantially central portion of the base;

e) the protective handle being aligned with the base to form a t-shape;

f) the protective handle dividing the base into a left side and a right side;

g) the protective handle having an extended handle length;

h) the protective handle being flexible;

i) the protective handle being able to flex toward the base so as to cause the substantially perpendicular angle to become more acute toward the left side and more obtuse toward the right side;

j) the protective handle being rollable;

k) the protective handle being a single protective handle;

l) the protective handle having at least two substantially planar sides;

m) the protective handle extending an entire width of the base;

n) the top surface and the bottom surface of the base being substantially planar;

o) the protective handle having a right side and a left side;

p) the top surface having a right top surface tangential and perpendicular to the right side of the protective handle;

q) the top surface having a left top surface tangential and perpendicular to the left side of the protective handle; and r) wherein a first scouring accessory is affixed to the bottom surface, and a first scrubbing accessory is affixed to the right top surface and the right side of the protective handle crossing over to the left side of the protective handle and the left top surface.

13. A scrubbing device comprising:

a) the scrubbing device having a base and a protective handle;

b) the base having a top surface and a bottom surface;

c) the protective handle extending upwardly from the base at a substantially perpendicular angle;

d) the protective handle extending upwardly from a substantially central portion of the base;

e) the protective handle being aligned with the base to form a t-shape;

f) the protective handle dividing the base into a left side and a right side;

g) the protective handle having an extended handle length;

h) the protective handle being flexible;

i) the protective handle being able to flex toward the base so as to cause the substantially perpendicular angle to become more acute toward the left side and more obtuse toward the right side;

j) the protective handle being rollable;

k) the protective handle being a single protective handle;

l) the protective handle having at least two substantially planar sides;

m) the protective handle extending an entire width of the base;

n) the top surface and the bottom surface of the base being substantially planar;

o) the protective handle having a right side and a left side;

p) the top surface having a right top surface tangential and perpendicular to the right side of the protective handle;

q) the top surface having a left top surface tangential and perpendicular to the left side of the protective handle; and r) wherein a first scouring accessory is affixed to the bottom surface, a second scouring accessory is affixed to the right top surface, and a third scouring accessory is affixed to the left top surface.

14. A scrubbing device comprising:

a) the scrubbing device having a base and a protective handle;

b) the base having a top surface and a bottom surface;

c) the protective handle extending upwardly from the base at a substantially perpendicular angle;

d) the protective handle extending upwardly from a substantially central portion of the base;

e) the protective handle being aligned with the base to form a t-shape;

f) the protective handle dividing the base into a left side and a right side;

g) the protective handle having an extended handle length;

h) the protective handle being flexible;

i) the protective handle being able to flex toward the base so as to cause the substantially perpendicular angle to become more acute toward the left side and more obtuse toward the right side;

j) the protective handle being rollable;

k) the protective handle being a single protective handle;

l) the protective handle having at least two substantially planar sides;

m) the protective handle extending an entire width of the base;

n) the top surface and the bottom surface of the base being substantially planar;

o) the protective handle having a right side and a left side;

p) the top surface having a right top surface tangential and perpendicular to the right side of the protective handle;

q) the top surface having a left top surface tangential and perpendicular to the left side of the protective handle; and r) wherein a first scrubbing accessory is affixed to the bottom surface, a second scrubbing accessory is affixed to the right top surface, and a third scrubbing accessory is affixed to the left top surface.

15. A scrubbing device comprising:

a) the scrubbing device having a base and a protective handle;

b) the base having a top surface and a bottom surface;

c) the protective handle extending upwardly from the base at a substantially perpendicular angle;

d) the protective handle extending upwardly from a substantially central portion of the base;

e) the protective handle being aligned with the base to form a t-shape;

f) the protective handle dividing the base into a left side and a right side;

g) the protective handle having an extended handle length;

h) the protective handle being flexible;

i) the protective handle being able to flex toward the base so as to cause the substantially perpendicular angle to become more acute toward the left side and more obtuse toward the right side;

j) the protective handle being rollable;

k) the protective handle being a single protective handle;

l) the protective handle having at least two substantially planar sides;

m) the protective handle extending an entire width of the base;

n) the top surface and the bottom surface of the base being substantially planar;

o) the protective handle having a right side and a left side;

p) the top surface having a right top surface tangential and perpendicular to the right side of the protective handle;

q) the top surface having a left top surface tangential and perpendicular to the left side of the protective handle; and r) wherein a first scrubbing accessory is affixed to the bottom surface, a first scouring accessory is affixed to the right top surface, and a second scouring accessory is affixed to the left top surface.

16. A scrubbing device comprising:

a) the scrubbing device having a base and a protective handle;

b) the base having a top surface and a bottom surface;

c) the protective handle extending upwardly from the base at a substantially perpendicular angle;

d) the protective handle extending upwardly from a substantially central portion of the base;

e) the protective handle being aligned with the base to form a t-shape;

f) the protective handle dividing the base into a left side and a right side;

g) the protective handle having an extended handle length;

h) the protective handle being flexible;

i) the protective handle being able to flex toward the base so as to cause the substantially perpendicular angle to become more acute toward the left side and more obtuse toward the right side;

j) the protective handle being rollable;

k) the protective handle being a single protective handle;

l) the protective handle having at least two substantially planar sides;

m) the protective handle extending an entire width of the base;

n) the top surface and the bottom surface of the base being substantially planar;

o) the protective handle having a right side and a left side;

p) the top surface having a right top surface tangential and perpendicular to the right side of the protective handle;

q) the top surface having a left top surface tangential and perpendicular to the left side of the protective handle; and r) wherein a first scouring accessory is affixed to the bottom surface, a first scrubbing accessory is affixed to the right top surface, and a second scrubbing accessory is affixed to the left top surface.

17. A scrubbing device comprising:

a) the scrubbing device having a base and a protective handle;

b) the base having a top surface and a bottom surface;

c) the protective handle extending upwardly from the base at a substantially perpendicular angle;

d) the protective handle extending upwardly from a substantially central portion of the base;

e) the protective handle being aligned with the base to form a t-shape;

f) the protective handle dividing the base into a left side and a right side;

g) the protective handle having an extended handle length;

h) the protective handle being flexible;

i) the protective handle being able to flex toward the base so as to cause the substantially perpendicular angle to become more acute toward the left side and more obtuse toward the right side;

j) the protective handle being rollable;

k) the protective handle being a single protective handle;

l) the protective handle having at least two substantially planar sides;

m) the protective handle extending an entire width of the base;

n) the top surface and the bottom surface of the base being substantially planar;

o) the protective handle having a right side and a left side;

p) the top surface having a right top surface tangential and perpendicular to the right side of the protective handle;

q) the top surface having a left top surface tangential and perpendicular to the left side of the protective handle; and r) wherein a first scrubbing accessory is affixed to the right top surface, a first scouring accessory is affixed to the left top surface.

* * * * *